US006630423B2

(12) United States Patent
Alvin et al.

(10) Patent No.: US 6,630,423 B2
(45) Date of Patent: Oct. 7, 2003

(54) GRADED METAL CATALYTIC TUBES

(75) Inventors: Mary Anne Alvin, Pittsburgh, PA (US); Gerald J. Bruck, Murrysville, PA (US)

(73) Assignee: Siemens Westinghouse Power Corporation, Orlando, FL (US)

( * ) Notice: Subject to any disclaimer, the term of this patent is extended or adjusted under 35 U.S.C. 154(b) by 0 days.

(21) Appl. No.: 09/822,389

(22) Filed: Mar. 30, 2001

(65) Prior Publication Data

US 2002/0139122 A1 Oct. 3, 2002

(51) Int. Cl.[7] ..... B01J 23/00; B01J 23/40

(52) U.S. Cl. ..... 502/527.19; 502/325; 502/326; 502/527.22; 502/439

(58) Field of Search ..... 502/439, 325, 502/326, 527.19, 527.22

(56) References Cited

U.S. PATENT DOCUMENTS 5,026,273 A 6/1991 Cornelison 5,511,972 A 4/1996 Dalla Betta et al.

FOREIGN PATENT DOCUMENTS

| | | | | |
|---|---|---|---|---|
| EP | 0661768 A1 | * | 7/1995 | ..... H01M/8/06 |
| JP | 6-281129 | * | 10/1994 | ..... F23K/5/08 |
| JP | 2000186803 | * | 7/2000 | ..... F23C/7/02 |

* cited by examiner

*Primary Examiner*—Stanley S. Silverman
*Assistant Examiner*—Jonas N. Strickland

(57) ABSTRACT

An improved metal catalytic tube includes an elongated metal member formed at least partially of metal particles and including a catalytic enhancement incorporated into the metal member. The metal member is formed with a cavity and includes an inner surface defined by the cavity and an outer surface opposite the inner surface. The metal member has a porosity at the outer surface that is greater than the porosity at the inner surface. The porosity at the inner surface is sufficiently low that the metal member can carry a quantity of gas through the cavity without the gas leaking through the inner surface of the metal member. The abstract shall not be used for interpreting the scope of the claims.

31 Claims, 4 Drawing Sheets

GRADED METAL CATALYTIC TUBES

BACKGROUND OF THE INVENTION

1. Field of the Invention

The present invention relates generally to combustion gas turbine engines and, more particularly, to combustion gas turbine engines that employ catalytic combustion principles in the environment of a lean premix burner. Specifically, the invention relates to graded metal catalytic tube that can be used in conjunction with a lean premix burner of a combustion gas turbine engine to reduce the production of undesirable nitrogen oxides.

2. Description of the Related Art

As is known in the relevant art, combustion gas turbine engines typically include a compressor section, a combustor section, and a turbine section. Large quantities of air or other gases are compressed in the compressor section and are delivered to the combustor section. The pressurized air in the combustor section is then mixed with fuel and combusted. The combustion gases flow out of the combustor section and into the turbine section where the combustion gases power a turbine and thereafter exit the engine. In its simplest form, the turbine section includes a shaft that drives the compressor section, and the energy of the combustion gases is greater than that required to run the compressor section. As such, the excess energy is taken directly from the turbine/compressor shaft or may be employed in the form of thrust, depending upon the specific application and the nature of the engine.

As is further known in the relevant art, some combustion gas turbine engines employ a lean premix burner that mixes excess quantities of air with the fuel to result in an extremely lean burn mixture. Such a lean burn mixture, when combusted, beneficially results in reduced production of nitrogen oxides ($NO_X$), which is desirable in order to comply with applicable emissions regulations, as well as for other reasons.

The combustion of such lean mixtures can, however, be somewhat unstable and thus catalytic combustion principles have been applied to such lean combustion systems to stabilize the combustion process. Catalytic combustion techniques typically involve flowing a mixture of fuel and air over a catalytic material that may be in the form of a precious metal such as platinum, palladium, rhodium, iridium, and the like. When the air/fuel mixture physically contacts the catalyst, the air/fuel mixture spontaneously begins to combust. Such combustion raises the temperature of the air/fuel mixture, which in turn enhances the stability of the combustion process.

In previous catalytic combustion systems, the catalytic materials typically were applied to the outer surface of a ceramic substrate to form a catalytic body. The catalytic body was then mounted within the combustor section of the combustion gas turbine engine. Ceramic materials were often selected for the substrate inasmuch as the operating temperature of a combustor section typically can reach 1600° Kelvin (1327° C.; 2420° F.), and ceramics were seen as the best substrate for use in such a hostile environment based on considerations of cost, effectiveness, and other considerations. In some instances, the ceramic substrate was in the form of a ceramic washcoat applied to an underlying metal substrate, with the catalytic material being applied to the ceramic washcoat.

The use of such ceramic substrates for the application of catalytic materials thereto has not, however, been without limitation. When exposed to typical process temperatures within the combustor section, the ceramic washcoat has been subject to spalling and/or cracking due to poor adhesion of the ceramic washcoat to the underlying metal substrate and/or mismatch in the coefficients of thermal expansion of the two materials. Such failure of the ceramic washcoat subsequently reduces catalytic performance. The catalytic material additionally can be lost directly from the ceramic material due to poor adhesion of the catalytic material onto the ceramic washcoat as well as mismatch in the coefficients of thermal expansion of the two materials. It is thus desired to provide an improved catalytic body that substantially reduces or eliminates the potential for reduced catalytic performance due to the use of ceramic materials.

In certain lean premix burner systems, it may be desirable to achieve the ultimate lean mixture by adding air in multiple stages to the fuel during the combustion process. With such a system, the operating parameters such as the temperature of the combustion process can be tightly controlled to beneficially reduce the production of undesirable emissions therefrom. It is thus desired that an improved catalytic body be provided that can be used in conjunction with such a multi-stage combustor section.

SUMMARY OF THE INVENTION

In view of the foregoing, an improved metal catalytic tube includes an elongated metal member formed at least partially of metal particles and including a catalytic enhancement incorporated into the metal member. The metal member is formed with a cavity and includes an inner surface defined by the cavity and an outer surface opposite the inner surface. The metal member has a porosity at the outer surface that is greater than the porosity at the inner surface. The porosity at the inner surface is sufficiently low that the metal member can carry a quantity of gas through the cavity without the gas leaking through the inner surface of the metal member.

The metal member can be constructed in various fashions, and typically is formed out of a quantity of metal particles that are compressed and bonded together. The metal particles can be in the form of metal fibers, metal powder, metal wire, and metal mesh, as well as other forms. The variation in porosity between the inner surface and outer surface can be achieved by using metal particles of different sizes, by varying the compression of the particles from the inner surface to the outer surface, by applying metal particles to the exterior surface of a solid metal pipe, as well as by other methods.

The catalytic enhancement likewise can be in many forms. For instance, the catalytic enhancement can be in the form of discrete particles of catalytic material that are combined with the metal particles to make the metal member. Alternatively, the metal particles themselves can be coated with catalytic material. Still alternatively, the catalytic enhancement can be in the form of a coating of catalytic material on the outer surface of the metal member, and can additionally include a ceramic coating such as a washcoat interposed between the catalytic materials and the metal particles of the metal member.

An objective of the present invention is thus to provide a metal catalytic tube that is formed at least partially out of metal particles.

Another objective of the present invention is to provide a metal catalytic tube having a catalytic enhancement incorporated therein.

Another objective of the present invention is to provide a metal catalytic tube formed with a cavity that can carry a quantity of gas through the cavity substantially without leakage.

Another objective of the present invention is to provide a metal catalytic tube having a metal member formed with a cavity and having an inner surface and an outer surface, the porosity of the metal member being greater at the outer surface then at the inner surface.

Another objective of the present invention is to provide a combustion gas turbine engine having a compressor section, a combustor section, and a turbine section, the combustor section including a metal catalytic tube that reduces undesirable emissions from the combustion gas turbine engine.

Another objective of the present invention is to provide a combustion gas turbine gas engine employing a metal catalytic tube in a multi-stage combustor section of the engine.

In view of the foregoing, an aspect of the present invention is to provide a metal catalytic tube, the general nature of which can be stated as including an elongated metal member formed with a cavity, the metal member being formed at least partially of metal particles. The metal member has an inner surface defined by the cavity and an opposite outer surface, with the metal member having a porosity at the outer surface that is greater than the porosity at the inner surface. The metal member is structured to carry a quantity of gas through the cavity substantially free of leakage through the inner surface, and includes a catalytic enhancement incorporated into the metal member.

Another aspect of the present invention is to provide a combustion gas turbine engine, the general nature of which can be stated as including a compressor section a combustor section, and a turbine section, with the combustor section including a metal catalytic tube. The metal catalytic tube includes an elongated metal member and a catalytic enhancement incorporated into the metal member. The metal member is formed with a cavity and is formed at least partially of metal particles. The metal member has an inner surface defined by the cavity and an opposite outer surface, with the metal member having a porosity at the outer surface that is greater than the porosity at the inner surface. The metal member is structured to carry a quantity of gas through the cavity substantially free of leakage through the inner surface.

Still another aspect of the present invention is to provide a method of combusting a quantity of fuel with a quantity of gas, the general nature of which can be stated as including the steps of flowing the fuel in a longitudinal direction over the outer surface of an elongated metal catalytic tube, interacting the fuel with a catalyst integrated with the metal catalytic tube to ignite the fuel, flowing the gas through a cavity in the metal catalytic tube, and mixing the gas with the ignited fuel.

BRIEF DESCRIPTION OF THE DRAWINGS

A further understanding of the invention can be gained from the following description of the preferred embodiments when read in conjunction with the accompanying drawings in which.

Similar numerals refer to similar parts throughout the specification.

DESCRIPTION OF THE PREFERRED EMBODIMENT

Figure 1:
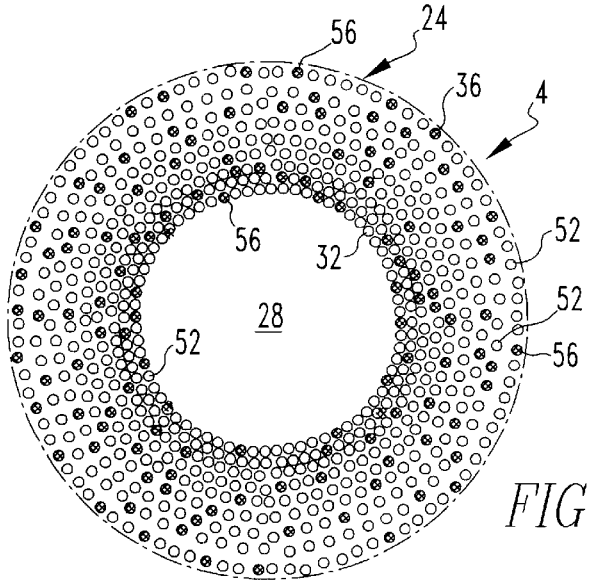
FIG. 1 is a cross sectional view of a first embodiment of a metal catalytic tube in accordance with the present invention.

A metal catalytic tube 4 in accordance with a first embodiment of the present invention is indicated generally in FIGS. 1 and 3–5. The metal catalytic tube 4 can be incorporated into a combustion gas turbine engine 8 (FIG. 2) to beneficially reduce the production of nitrogen oxides ($NO_x$), as will be set forth more fully below. As is known in the relevant art, the combustion gas turbine engine 8 includes a compressor section 12, a combustor section 16, and a turbine section 20.

Figure 2:
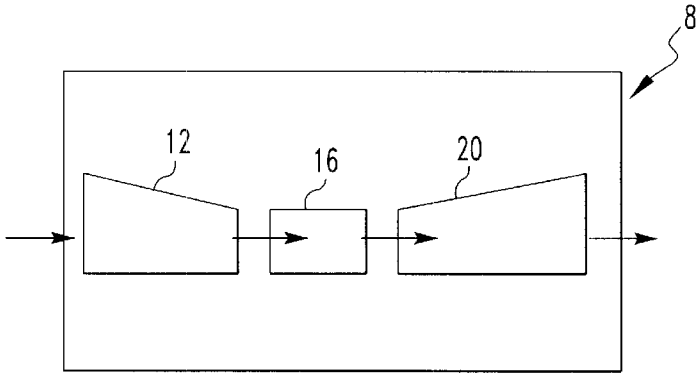
FIG.2 PRIOR ART
FIG. 2 is a schematic view of a combustion gas turbine engine into which the present invention can be incorporated.

As is depicted schematically in FIG. 2, the combustion gas turbine engine 8 serially flows large quantities of air from the compressor section 12 to the combustor section 16 and thereafter to the turbine section 20. The metal catalytic tube 4 of the present invention can be incorporated into the combustor section 16 to facilitate catalytic combustion of an air/fuel mixture and can be employed in conjunction with a lean premix burner, as will be set forth more fully below. While the combustion gas turbine engine 8 and the metal catalytic tube 4 are anticipated to be used in conjunction with air, it is understood that they can be used with another appropriate gas or combination of gases without departing from the concept of the present invention. As such, the word "air" used herein is intended to refer to any gas or combination of gases.

As is best shown in FIG. 1, the metal catalytic tube 4 includes an elongated metal member 24 formed with a cavity 28 extending therethrough. The cavity 28 thus defines an inner surface 32 on the metal member 24, with the metal member 24 additionally including an outer surface represented in FIG. 1 by the phantom line 36 that is opposite the inner surface 32. While the metal member 24 is depicted in FIG. 1 as being of a substantially circular cross section, it is understood that the metal member 24 can be of other non-circular cross sections without departing from the concept of the present invention, as will be set forth more fully below.

The metal member 24 is manufactured out of a quantity of metal particles that are compressed and bonded together such as by sintering. As used herein, the term "compress" and variations thereof refers inclusively to various forms of compression and compaction that can occur mechanically, inertially, gravitationally, or otherwise. It is understood, however, that in other embodiments (such as will be set forth more fully below) the metal member 24 can be made of metal particles that are not compressed and/or that are not bonded depending upon the specific needs of the particular application, without departing from the concept of the present invention. It is desired, however, that at least a portion of the metal member 24 remain porous, as will be set forth more fully below.

The porosity of the metal member 24 is greater at the outer surface 36 than at the inner surface 32. The porosity at the inner surface 32 is sufficiently low, meaning that the metal member 24 is sufficiently dense at the inner surface 32, that a quantity of gas, or a mixture of gases such as air, can be carried through the cavity 28 substantially without leakage of the gas through the inner surface 32 and into the metal member 24 for purposes to be set forth more fully below.

Figure 3:
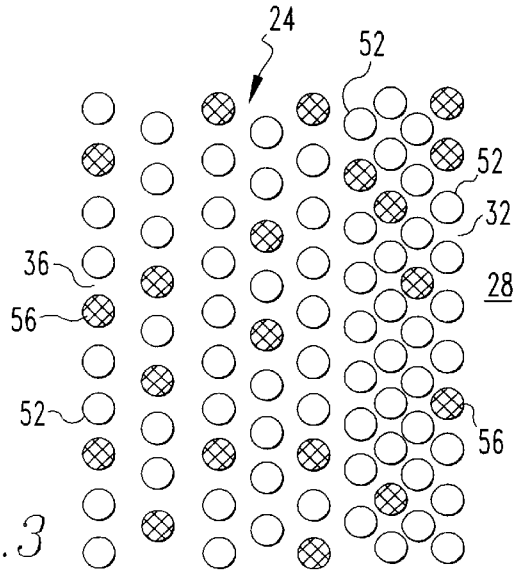
FIG. 3 is a schematic cross sectional view of a portion of the first embodiment.
Figure 4:
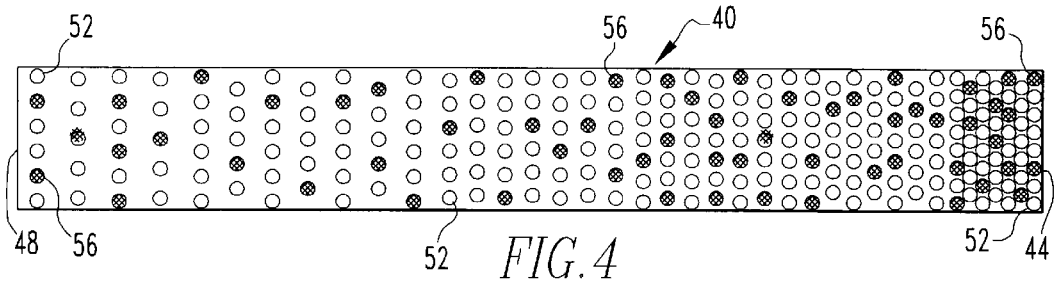
FIG. 4 is a schematic cross sectional view of a sheet of metal particles used in making the first embodiment.
Figure 5:
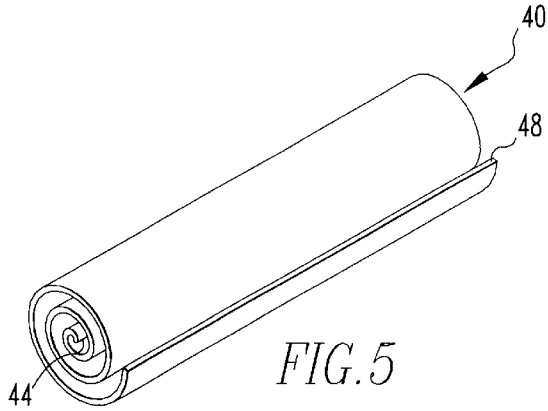
FIG. 5 is a schematic representation of the sheet being wound in a spiral to form the first embodiment.

As can be seen in FIGS. 3–5, the metal member 24 is made of a sheet 40 having a first end 44 and a second opposite end 48, and that is spiral-wound to form the hollow metal member 24. The sheet 40 includes a quantity of metal particles 52 that can be in the form of one or more of metal fibers, metal powder, metal wire, and metal mesh, although other forms of metal particles can be employed without departing from the concept of the present invention. The sheet 40 additionally includes a catalytic enhancement incorporated therein in the form of particles of catalytic material 56 that are combined with or interspersed throughout the metal particles 52.

The metal particles 52 can be made out of any of a variety of appropriate metals including superalloy and intermetallic materials, as well as other metals that are suited to withstand the high temperature environment of the combustor section 16. As is understood in the relevant art, a "superalloy" typically includes a nickel, cobalt, or iron base that is alloyed with other materials such as aluminum, titanium, and chromium in various combinations and proportions, although numerous other alloys can be used for the manufacture of the metal particles 52. Intermetallic materials include iron aluminide, nickel aluminide, and the like. Alloys that can be used for making the metal particles 52 include Haynes 230, Haynes 214, Haynes 556, FeCrAlY, and the like. As an example, if the metal particles 52 are in the form of fibers, such fibers may be of a diameter in approximately the range 2–50 microns, although the fibers can be of other sizes, as will be set forth more fully below.

The particles of catalytic material 56 can be any of a variety of known catalytic materials such as the precious metals platinum, palladium, rhodium, and iridium, although other catalytic materials may be employed without departing from the concept of the present invention. As is depicted schematically in FIGS. 3 and 4, the particles of catalytic material 56 are depicted as being of approximately the same size as the metal particles 52 and as being interspersed throughout the metal particles 52. In this regard, it is understood that the particles of catalytic material 56 can be larger and/or smaller than the metal particles 52 without departing from the concept of the present invention. Moreover, the amount of metal particles 52 relative to the amount of particles of catalytic material 56 can be varied depending upon the specific needs of the particular application. While the particles of catalytic material are depicted in FIGS. 1, 3, and 4 as being dispersed generally evenly throughout the metal member 24 between the inner and outer surfaces 32 and 36, it is understood that in other embodiments the particles of catalytic material 56 may be generally concentrated at the outer surface 36 with relatively fewer of the particles of catalytic material 56 being disposed at the inner surface 32 without departing from the concept of the present invention.

As is indicated schematically in FIG. 4, the metal particles 52 and the particles of catalytic material 56 are spaced apart from one another by greater distances at the second end 48 of the sheet 40 than at the first end 44. As such, the density of the sheet 40 is greater at the first end 44 than at the second end 48. The sheet 40 can also be said to have a graded porosity or density, and still alternatively can be said to be asymmetrical. Such variation in density, i.e. porosity, can be accomplished by compressing the metal particles 52 and particles of catalytic material 56 to a greater degree at the first end 44 than at the second end 48. In other embodiments set forth below, it will be shown that the variation in porosity can be achieved through the use of metal particles and particles of catalytic material that gradually increase in size from the first end to the second end without the need for varying the degree of compression thereof.

As is indicated schematically in FIG. 5, the sheet 40 is then spiral-wound to form the metal member 24, with the first end 44 of the sheet 40 being at the inner surface 32, and the second end 48 of the sheet 40 being at the outer surface 36. After being spiral-wound, the sheet 40 may receive additional compression if needed to configure the metal member 24 in a particular fashion.

The metal particles 52 and particles of catalytic material 56 of the spiral-wound sheet 40 are then bonded with one another to retain the metal member 24 in the tubular configuration depicted generally in FIG. 1 and to reduce the porosity at the inner surface 32 sufficiently to permit the gas to be carried through the cavity 28 without leakage. While numerous bonding methodologies may be employed, such as sintering, one particular method of bonding the spiral-wound sheet 40 involves the application of heat from an incandescent filament (not shown) extending coaxially through the spiral-wound sheet 40. Such an incandescent filament disposed coaxially within the cavity 28 applies heat directly to the inner surface 32 to bond together the metal particles 52 and particles of catalytic material 56 at the inner surface 32 until the porosity of the metal member 24 at the inner surface 32 is sufficiently low that the gas can be carried within the cavity 28 without leakage through the inner surface 32. Such heat also has the effect of bonding together the other metal particles 52 and particles of catalytic material 56 throughout the metal member 24, with the metal member 24 having a greater porosity at the outer surface 36 than at the inner surface 32. It is understood, however, that other methodologies may be employed for bonding the metal particles 52 and the particles of catalytic material 56 so long as the inner surface 32 is sufficiently dense to resist leakage of the gas therethrough and the outer surface 36 retains at least a nominal level of porosity.

In use, the metal catalytic tube 4 is positioned in the combustor section 16 of the combustion gas turbine engine 8 such that the air/fuel mixture passes over and is in contact with the outer surface 36 of the metal member 24. As is understood in the relevant art, the air/fuel mixture spontaneously begins to combust upon contacting the particles of catalytic material 56 of the metal member 24, with the combustion resulting from a catalytic reaction due to the interaction between the particles of catalytic material 56 and the air/fuel mixture.

The combustor section 16 typically includes a plurality of the metal catalytic tubes 4 oriented in a direction substantially parallel with the flow of the air/fuel mixture such that the air/fuel mixture flows longitudinally over the outer surfaces 36 of the metal catalytic tubes 4. Inasmuch as the metal member 24 is at least nominally porous at the outer surface 36, the air/fuel mixture additionally flows into contact with the inner regions of the metal member 24 between the outer and inner surfaces 36 and 32, whereby such porosity of the metal member 24 increases the surface area of the metal member 24 for catalytic interaction with the air/fuel stream. Such porosity thus has the effect of enhancing the spontaneous combustion of the air/fuel mixture as it contacts the metal catalytic tube 4.

The metal catalytic tube 4 can advantageously be employed in a multiple-stage lean premix burner. In particular, the metal catalytic tube 4 can carry through the cavity 28 a stream of a gas, or a mixture of gases such as air, that can be discharged out of an open end of the metal catalytic tube 4 and thus mixed with the combusting air/fuel mixture to achieve a final desirable air/fuel mixture. In such a configuration, an initial air/fuel mixture flows longitudinally in a first direction over the outer surface 36 of the metal catalytic tube 4, whereby combustion of the initial air/fuel mixture is initiated by catalytic interaction with the particles of catalytic material 56 of the metal member 24. Simultaneously therewith, the gas flows substantially without leakage through the cavity 28 in the same direction. The metal catalytic tube 4 terminates at an open downstream end (not shown). As the combusting initial air/fuel mixture flows past the downstream end of the metal catalytic tube 4, the gas flowing through the cavity 28 is discharged out of the open downstream end and is mixed with the combusting initial air/fuel mixture to achieve a final air/fuel mixture that is specifically configured to beneficially reduce the production of nitrogen oxides ($NO_x$). The combustion gas turbine engine 8 may additionally include a control system that controls the rate at which the additional air is added to the initial air/fuel mixture according to various criteria such as the operating temperature of the combustor section 16, as well as other criteria.

The metal catalytic tube 4 thus is configured as a single unit with a catalytic enhancement incorporated therein. The bonding of the metal particles 52 and the particles of catalytic material 56 with one another resists mechanical failure of the catalytic enhancement. In this regard, the area of contact among the metal particles 52 and the particles of catalytic material 56 is sufficiently great to retain the metal member 24 as a cohesive unit despite high operating temperatures and repeated start-up and shut-down operations of the combustion gas turbine engine 8. Moreover, the coefficients of thermal expansion of the metal particles 52 and the particles of catalytic material 56 are sufficiently similar to avoid any meaningful likelihood that different degrees of thermal growth of the metal particles 52 and the particles of catalytic material 56 may cause a mechanical rupture or other failure of the metal member 24.

As such, the metal catalytic tube 4 is advantageously configured to be used for prolonged periods in the combustor section 16 at the operating temperatures ordinarily experienced therein and during repeated start-up and shut-down cycles without failure. The metal catalytic tube 4 additionally is configured to be employed in a multiple-stage combustion operation whereby quantities of air are added to an initial air/fuel mixture after the initiation of combustion thereof. In this regard, it is additionally understood that in some applications the gas or gases that are initially mixed with the fuel prior to the catalytic combustion thereof may be different than the gas or gases that are carried through the metal catalytic tube 4 and are added to the combusting fuel, such as when an initial gas is mixed with the fuel prior to catalytic combustion and a dilution gas is combined therewith after the initiation of combustion.

The metal catalytic tube 4 advantageously incorporates a catalytic enhancement into the metal member 24 by combining the particles of catalytic material 56 with the metal particles 52, both of which are capable of sustained operation at the temperatures normally experienced within the combustor section 16 and are also tolerant of rapid thermal cycle events such as startup and shutdown of the engine 8. The metal catalytic tube 4 thus provides a prolonged catalytic effect to the air/fuel mixture within the combustion gas turbine engine 8 without the shortcomings such as thermal fatigue, micro-cracking, and the like that typically can be experienced in applying catalytic materials to a ceramic substrate. Moreover, the metal catalytic tube 4 avoids the need for a ceramic washcoat on an underlying metal substrate, thus resulting in a reduced-cost catalytic body that can be produced in shorter time. It is understood, however, that the metal catalytic tube 4 may be configured to include a ceramic washcoat without departing from the concept of the present invention.

While the metal member 24 is depicted in FIGS. 1 and 5 as being of a hollow substantially cylindrical configuration and thus having a substantially circular cross section, it is understood that in other embodiments the metal member 24 may be of non-circular cross sections without departing from the concept of the present invention. For instance, the metal member 24 may be made up of one or more generally planar metal members that are connected with one another and/or one or more tube sheets to form an elongated member having a hollow generally polygonal cross section. Such an embodiment may include a polygonal cavity through which the air may flow. The generally planar metal members could be of an increasing porosity in a direction extending outwardly from the polygonal cavity.

In still other alternative embodiments, the metal catalytic tube may be configured out of a pair of metal members in the form of panels that are formed with one or more lengthwise corrugations, whereby the corrugations of one metal member may be juxtaposed with the corrugations of the other metal member and the two metal members connected with one another. In such a configuration, each juxtaposed pair of corrugations would define an elongated cavity through which the air may flow. A metal catalytic tube formed of metal members that are each formed with a plurality of corrugations would include a plurality of cavities that may be parallel with one another. Such corrugations may be of an angular nature or may be in the form of smooth non-angular undulations in the metal members, or a combination of both. Again, the panels may be of an increasing porosity in a direction extending outwardly from the cavities.

Figure 6:
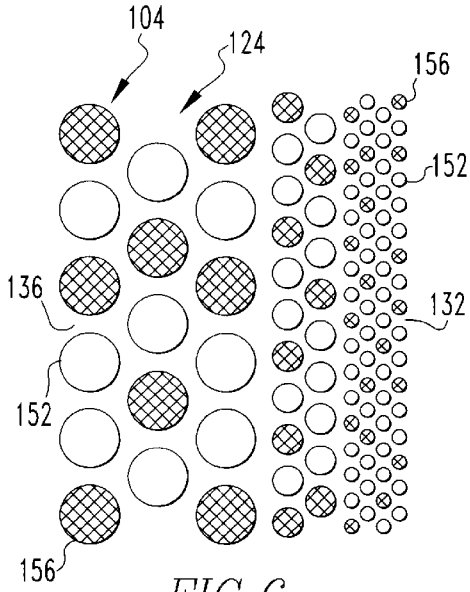
FIG. 6 is a view similar to FIG. 3, except depicting a second embodiment of a metal catalytic tube in accordance with the present invention.

A second embodiment of a metal catalytic tube 104 in accordance with the present invention is indicated generally in FIG. 6. More particularly, FIG. 6 is a schematic cross sectional view of a metal member 124 of the metal catalytic tube 104, with the metal member 124 including a catalytic enhancement incorporated therein. The metal member 124 is similar to the metal member 24, except that the metal member 124 is formed of metal particles 152 and particles of catalytic material 156 that vary in size from relatively larger at the outer surface 136 to relatively smaller at the inner surface 132. Such a size-based distribution of particles causes the metal member 124 to have a greater porosity at the outer surface 136 than at the inner surface 132.

As was indicated above regarding the metal catalytic tube 4, the graded porosity of the metal member 24 was achieved by employing metal particles 52 and particles of catalytic material 56 of roughly the same size and by compressing the particles at the inner surface 32 to a greater degree than the particles at the outer surface 36. In contrast, the metal member 124 has a graded porosity due to the increase in the size of the metal particles 152 and the particles of catalytic material 156 in going from the inner surface 132 to the outer surface 136. While all of the metal particles 152 and particles of catalytic material 156 of the metal member 124 are compressed to substantially the same degree, it is understood that different degrees of compression can also be employed to specifically configure the porosity at various points within the metal member 124. It is further understood that while the particles of catalytic material 156 are depicted in FIG. 6 as being of comparable size to corresponding metal particles 152, it is understood that the beneficial aspects of the metal catalytic tube 104, including the graded porosity of the metal member 124, can be achieved without strict correspondence of the size of the particles of catalytic material 156 with that of the metal particles 152.

Figure 7:
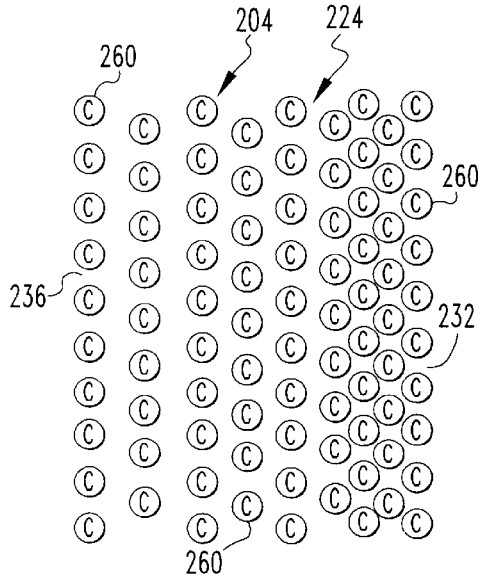
FIG. 7 is a view similar to FIG. 3, except depicting a third embodiment of a metal catalytic tube in accordance with the present invention.

A third embodiment of a metal catalytic tube 204 in accordance with the present invention is indicated generally in FIG. 7. More particularly, FIG. 7 is a schematic cross sectional view of a metal member 224 of the metal catalytic tube 204, with the metal member 224 having a catalytic enhancement incorporated therein. The metal member 224 is similar to the metal member 24, except that the catalytic enhancement incorporated into the metal member 224 is different than the catalytic enhancement incorporated into the metal member 24.

More particularly, the catalytic enhancement to the metal member 224 is in the nature of a coating of catalytic material on the individual metal particles of the metal member 224. As can be seen in FIG. 7, the metal member 224 includes numerous metal particles coated with catalytic material 260 that are depicted as being of substantially the same size. It can further be seen from FIG. 7 that the metal particles coated with catalytic material 260 are arranged such that the porosity of the metal member 224 is greater at the outer surface 236 than at the inner surface 232, in a fashion similar to that of the metal member 24.

By coating the metal particles of the metal member 224 with catalytic material instead of dispersing discrete particles of catalytic material within the metal member 224, the metal member 224 can have a relatively high catalytic effect on the air/fuel mixture while using relatively less catalytic material, which is typically costly, than if the metal particles coated with catalytic material 260 were configured out of solid catalytic material. In this regard, while FIG. 7 depicts all of the particles of the metal member 224 as being coated with catalytic material, it is understood that in other embodiments fewer than all of the metal particles can be coated with the catalytic material without departing from the concept of the present invention. Moreover, while the particles depicted in FIG. 7 are all depicted as being of substantially the same size and compressed to varying degrees to achieve an increase in porosity of the metal member 224 from the inner surface 232 to the outer surface 236, it is understood that in other embodiments the graded porosity can be achieved by employing different size particles in a fashion similar to that of the metal member 124 without departing from the concept of the present invention. The metal catalytic tube 204 thus achieves the same objectives as the metal catalytic tube 4, but can be configured to require smaller amounts of the catalytic material with potential cost savings.

Figure 8:
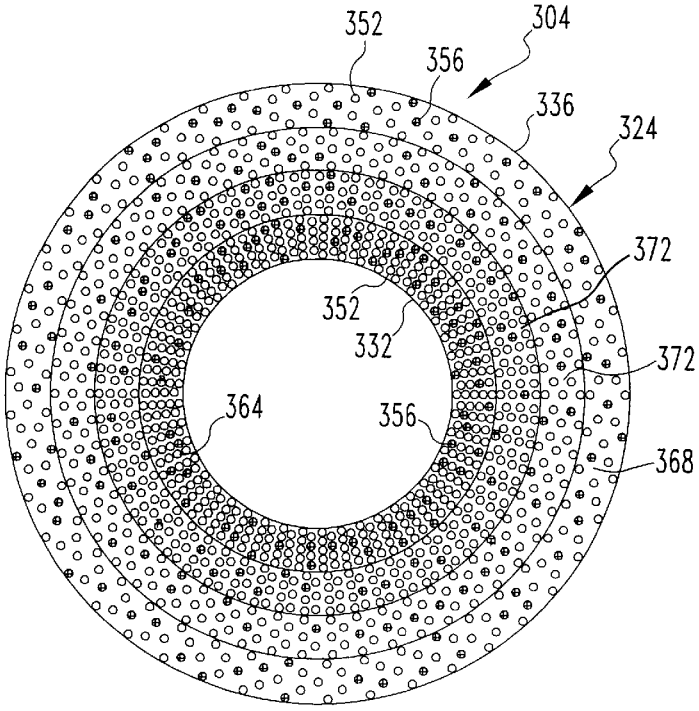
FIG. 8 is a cross sectional view of a fourth embodiment of a metal catalytic tube in accordance with the present invention.

A fourth embodiment of a metal catalytic tube 304 in accordance with the present invention is indicated generally in FIG. 8. More specifically, FIG. 8 depicts a cross section of a metal member 324 having a catalytic enhancement incorporated therein. The metal member 324 is similar to the metal member 24, except that the metal member 324 includes a plurality of discrete layers of metallic material instead of employing a single sheet of metallic material that is spiral-wound.

As can be seen in FIG. 8, the metal member 324 includes a first layer 364 which defines the inner surface 332 of the metal member 324, and a second layer 368 that defines the outer surface 336. FIG. 8 additionally depicts a pair of intermediate layers 372 that are interposed between the first and second layers 364 and 368. The porosity of the metal member 324 is greater at the outer surface 336 than at the inner surface 332, and such graded porosity is achieved by employing particles of substantially the same size that are compressed to a greater degree within the first layer 364 than in the second layer 368, and it can further be seen that the metal particles 352 and the particles of catalytic material 356 are all of substantially the same size. In this regard, it is understood that in other embodiments the metal member 324 can include particles of varying sizes, such as those employed in the metal member 124, and can still alternatively or in addition thereto employ metal particles coated with catalytic material such as those employed in the metal member 224, without departing from the concept of the present invention.

The multi-layered metal member 324 can be manufactured in any of a wide variety of fashions. For instance, the metal member 324 can be formed out of a plurality of sheets of metallic material that are rolled in an appropriate shape and bonded with one another, with each of the sheets forming a layer of the metal member 324. As another alternative, the metal member 324 can be formed by the centrifugal rotation of a slurry containing metal particles to form the second layer 368, with additional layers being formed by additional centrifugation operations with different slurry compounds or with the same slurry compound at different rotational velocities. If needed, each layer can be filled with an organic filler prior to application of each subsequent layer, with the organic filler then being burned out during the bonding operation of the metal member 324. Other methodologies will be apparent to those skilled in the art.

The graded porosity of the metal member 324 thus can be controlled due to each layer of the metal member 324 being individually formed. While the metal member 324 is depicted as including four layers, it is understood that the metal member 324 can have greater or lesser numbers of layers without departing from the concept of the present invention.

Figure 9:
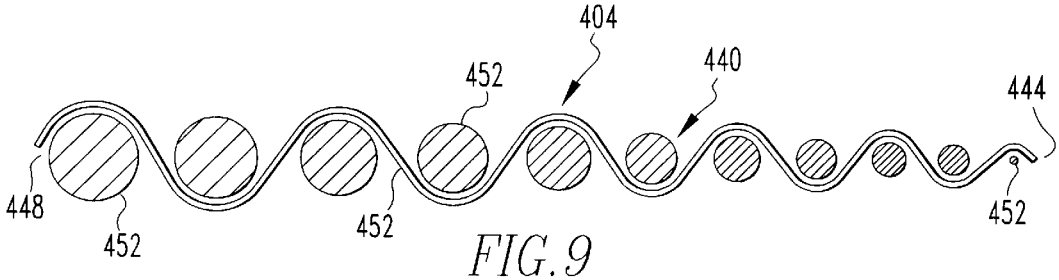
FIG. 9 is a cross sectional view of a sheet of metal particles that is used to make a fifth embodiment of a metal catalytic tube in accordance with the present invention.

A fifth embodiment of a metal catalytic tube 404 in accordance with the present invention is indicated generally in FIG. 9. More particularly, FIG. 9 is a schematic cross sectional view of a sheet 440 of metal particles that gradually increase in average size from a first end 444 to a second end 448. The metal particles are indicated generally at the numeral 452, and can be in the form of metal fibers, metal powder, metal wires, and metal mesh, as well as other configurations. Moreover, the sheet 440 includes a catalytic enhancement incorporated therein that is not depicted in FIG. 9 for purposes of clarity. The catalytic enhancement can be in the form of any of the catalytic enhancements depicted herein, such as the use of discrete particles of catalytic material and the application of coatings of catalytic material, as well as any other appropriate method.

The sheet 440 is depicted in FIG. 9 as being in the form of a mesh or screen in which the fibers of either or both of the warp and woof increase in size from the first end 444 to the second end 448. The sheet 440 is then spiral-wound in a fashion similar to that of the sheet 40 depicted in FIG. 5, such that the first end 444 is disposed at the inner surface and the second end 448 is disposed at the outer surface. The spiral-wound sheet 440 can then be bonded, or alternatively can be fixed in the spiral-wound condition by weaving additional metal particles throughout various regions of the spiral-wound sheet 440 or by other non-bonding techniques.

The increasing porosity of the metal catalytic tube 404 from the inner surface to the outer surface thus results from the use of particles that increase in size from the inner surface to the outer surface. In this regard, while the metal particles are schematically depicted in FIG. 9 as being individual fibers of gradually increasing diameter in a direction from the first end 444 toward the second end 448, it is understood that if different types of metal particles are employed in making the sheet 440, a similar increase in the size of the metal particles can be achieved so long as the smallest physical dimension of at least one of the metal particles at the second end 448 is greater than the smallest physical dimension of at least one of the metal particles at the first end 444, assuming that the particles at a given region of the metal catalytic tube 404 are of approximately the same given size. It is additionally understood, however, that different measuring methodologies may be employed to conclude that the particles, on average, increase in size from the first end 444 to the second end 448 to achieve the beneficial increase in porosity from the inner surface to the outer surface as depicted above. The metal catalytic tube 404 thus can be manufactured by specifically configuring a sheet 440 of particles and by spiral-winding the sheet 440 to achieve the metal catalytic tube 404. Moreover, the metal catalytic tube 404 can be formed without bonding the metal particles 452 to one another, but rather can be formed by retaining the sheet 440 in its spiral-wound configuration by other methodologies.

Figure 10:
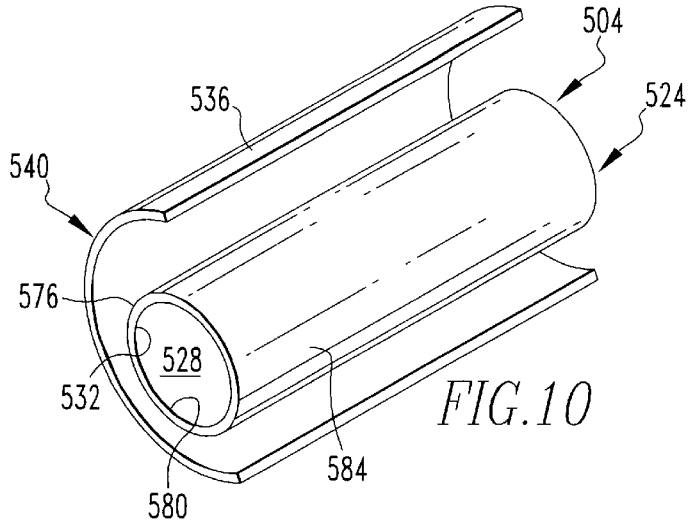
FIG. 10 is a schematic exploded perspective view of a sixth embodiment of a metal catalytic tube in accordance with the present invention.
Figure 11:
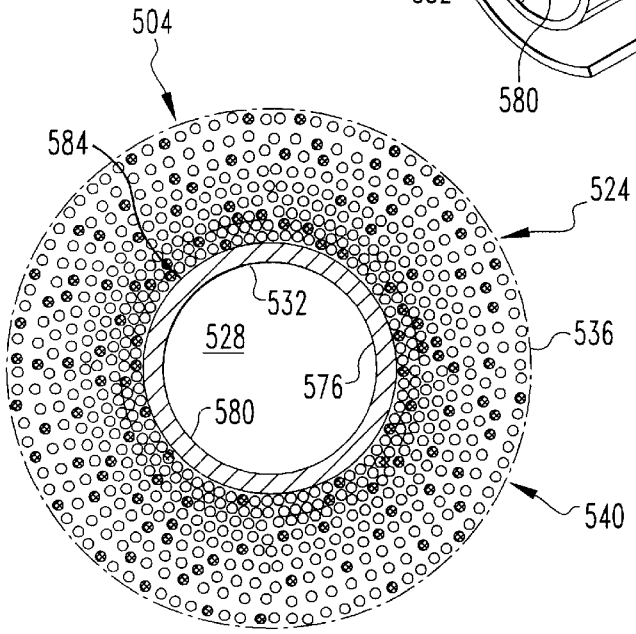
FIG. 11 is a cross sectional view of the sixth embodiment.

A sixth embodiment of a metal catalytic tube 504 is indicated generally in FIGS. 10 and 11. The metal catalytic tube 504 includes a metal member 524 having a catalytic enhancement incorporated therein. More specifically, the metal member 524 includes a sheet 540 of metallic material that is disposed about the exterior surface 584 of an elongated metal pipe 576. The metal pipe 576 is formed with a cavity 528 extending therethrough that defines an interior surface 580 opposite the exterior surface 584. In the embodiment of the metal catalytic tube 504 depicted in FIGS. 10 and 11, the sheet 540 is depicted as being wrapped at least once around the exterior surface 584 of the metal pipe 576. The sheet 540 is then bonded to the metal pipe 576 by an appropriate method.

With the sheet 540 and the metal pipe 576 bonded together to form the metal member 524, it can be seen that the interior surface 580 of the metal pipe 576 defines the inner surface 532 of the metal member 524, and it can further be seen that the outermost surface of the sheet 540 (depicted by a phantom line in FIG. 11) defines the outer surface 536. It thus can be seen that the porosity of the metal member 524 is greater at the outer surface 536 than at the inner surface 532 inasmuch as the sheet 540, which includes a plurality of metal particles, has a porosity that is greater than the porosity of the solid metal pipe 576.

While the sheet 540 is depicted in FIG. 11 as itself having a porosity that increases from its area of contact with the exterior surface 584 of the metal pipe 576 to the outer surface 536, it is understood that in other embodiments, the sheet 540 may be configured to have an unvarying porosity throughout. In such an alternate embodiment, the porosity of the metal member 524 as a whole will be greater at the outer surface 536 than at the inner surface 532 inasmuch as the inner surface 532 will be defined by the cavity 528 of the solid metal pipe 576, while the outer surface 536 will be defined by the sheet 540 of metal particles. As such, the sheet 540 may itself be configured to have a graded porosity or a constant porosity while still allowing the metal member 524 as a whole to be configured with a porosity that is greater at the outer surface 536 than at the inner surface 532.

As indicated hereinbefore, the metal member 524 includes a catalytic enhancement incorporated therein, although the catalytic enhancement is not depicted in FIG. 10 for purposes of clarity. It is understood that any of the different types of catalytic enhancement described herein may be incorporated into the metal member 524 depending upon the specific needs of the particular application.

While the metal catalytic tube 4 is depicted in FIGS. 10 and 11 as being formed of the sheet 540 that is physically wrapped about the exterior surface 584 of the metal pipe 576, it is further understood that in alternate embodiments (not shown) the metal member 524 can be configured by applying other metal particles directly to the exterior surface 584. For instance, the metal particles can be in the form of a slurry that is slip cast on the exterior surface 584 of the metal pipe 576, with the metal particles then being bonded to each other as well as to the metal pipe 576 by an appropriate method. Still alternatively, metal particles in the form of a filament may be wound on the exterior surface 584 of the metal pipe 576, with an additional optional coating of other metal particles to the fibers themselves, followed by bonding of the metal particles to the metal pipe 576 and to one another if needed.

In other embodiments, the sheet 540 may actually be in the form of several sheets of increasing porosity from the exterior surface 584 of the metal pipe 576 to the outer surface 536 of the metal member 524. Alternatively, the sheet 540 may be in the form of one or more screens having porosity that is constant or that increases from the exterior surface 584 of the metal pipe 576 to the outer surface 536 of the metal member 524. Still alternatively the sheet 440 depicted generally in FIG. 9 may be mounted on the metal pipe 576.

The metal pipe 576 can be configured of an appropriate material that is suited to the application of metal particles to the exterior surface 584 thereof and that is suited to the high temperature of the combustor section 16 of the combustion gas turbine engine 8. The metal pipe 576 preferably will have a coefficient of thermal expansion that is comparable to that of the sheet 540 in order to minimize undesirable mechanical loading therebetween, but a certain amount of mismatch between the coefficients of thermal expansion is acceptable depending upon the specific needs of the particular application and the properties of the metals out of which the metal member 524 is manufactured. The metal catalytic tube 504 thus can carry a quantity of gas through the cavity 528 without leakage and provides a catalytic enhancement incorporated into the metal member 524 to catalytically interact with and ignite the air/fuel mixture.

Figure 12:
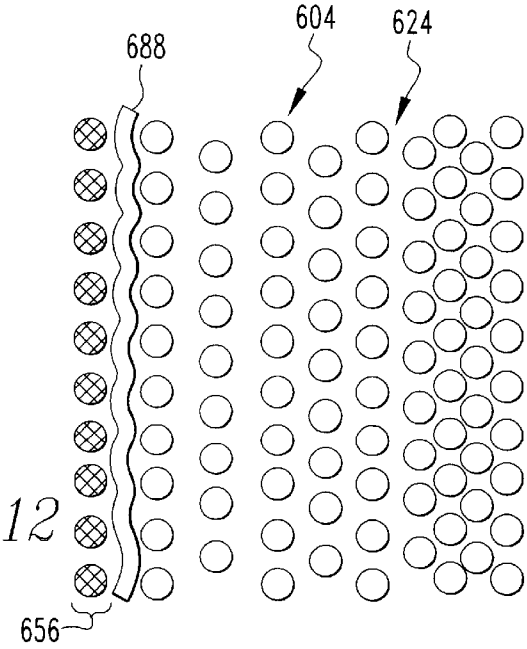
FIG. 12 is a view similar to FIG. 3, except depicting a seventh embodiment of a metal catalytic tube in accordance with the present invention.

A seventh embodiment of a metal catalytic tube 604 in accordance with the present invention is indicated generally in FIG. 12. More specifically, FIG. 12 is a schematic cross sectional view of a metal member 624 of the metal catalytic tube 604, with the metal member 624 having a catalytic enhancement incorporated therein. The metal member 624 is similar to the metal member 24, except that the catalytic enhancement incorporated into the metal member 624 is different.

More specifically, the metal member 624 includes a ceramic coating 688 on the outermost surface thereof, with the catalytic enhancement being in the form of a plurality of particles of catalytic material 656 disposed on the ceramic coating 688. The ceramic coating 688 may be in the form of a ceramic washcoat applied to the porous metal of the metal member 624. While the ceramic coating 688 is depicted for purposed of clarity and simplicity in FIG. 12 as a contiguous layer without voids or holes therein, it is understood that the ceramic coating may be a non-contiguous configuration without departing from the concept of the present invention. The porosity of the surface of the metal member 624 to which the ceramic coating 688 is attached permits secure adhesion of the ceramic coating 688 via interlocking the ceramic coating 688 within the porous metal member 624. The metal member 624 thus overcomes problems that had previously been associated with the application of ceramic materials to smooth metal substrates.

The particles of catalytic material 656 can be in the form of discrete particles of catalytic materials that are applied to the ceramic coating 688 or may include a single coating or layer of catalytic material that may be applied by dip coating, slurry application, plating, and electrodeposition, as well as other methods. Moreover, in other embodiments (not shown) the ceramic coating 688 may be eliminated, and the particles of catalytic material 656 applied directly to the metal member 624 to provide the catalytic enhancement incorporated therein.

The porosity of the metal member 624 is depicted as increasing from the inner surface thereof to the outer surface thereof, and such graded porosity is depicted as being achieved through the use of an increased degree of compression of the metal particles at the inner surface than at the outer surface. It is understood, however, that other methodologies, such as those depicted herein, may be employed to provide a graded porosity to the metal member 624. It is further understood that the catalytic enhancement depicted in conjunction with the metal catalytic tube 604 can be employed in any of the foregoing metal catalytic tubes 4, 104, 204, 304, 404, and 504, without departing from the concept of the present invention.

As can be seen from the foregoing, several different types of metal catalytic tubes 4, 104, 204, 304, 404, 504, and 604 are described herein and can be used in conjunction with catalytic combustion in the combustion gas turbine engine 8. The metal catalytic tubes additionally can be employed in multi-stage catalytic combustion and/or fuel and air mixing operations. While numerous features are depicted herein, it is understood that many of the features can be combined in other fashions not specifically indicated herein without departing from the concept of the present invention.

The foregoing discloses a plurality of metal catalytic tubes 4, 104, 204, 304, 404, 504, and 604 that can be configured in numerous ways to achieve specific objectives of particular applications. For instance, the configurations thereof can be based upon the required operating environment, cost considerations, catalytic needs of the application, as well as numerous other considerations. The present invention thus provides metal catalytic tubes 4, 104, 204, 304, 404, 504, and 604 that provide enhanced function over previously known devices and that overcome many of the shortcomings associated with such devices.

While a number of particular embodiments of the present invention have been illustrated herein, it is understood that various changes, additions, modifications, and adaptations may be made without departing from the scope of the present invention, as set forth in the following claims.

What is claimed is:

1. A metal catalytic tube comprising:

an elongated metal member firmed with a cavity, the metal member being formed of a plurality of sinter bonded metal fibers;

the metal member having an inner surface defined by the cavity and an opposite outer surface, the metal member having a porosity at the outer surface that is greater than the porosity at the inner surface, the metal member being structured to carry a quantity of gas through the cavity substantially free of leakage through the inner surface; and the plurality of sinter bonded metal fibers having a catalytic enhancement particles inter-dispersed therein.

2. The metal catalytic tube as set forth in claim 1, in which the particles of catalytic material include at least one catalytic material selected from the group consisting of platinum, palladium, rhodium, and iridium.

3. The metal catalytic tube as set forth in claim 1, in which the catalytic enhancement includes particles of catalytic material disposed on the outer surface of the metal member.

4. The metal catalytic tube as set forth in claim 3, which the metal member includes a ceramic coating the particles of catalytic material being disposed on the ceramic coating.

5. The metal catalytic tube as set forth in claim 4 in which the metal member includes a spiral-wound sheet of metal fibers.

6. The metal catalytic tube as set forth in claim 5, in which the sheet of metal fibers has a first end and a second end, the first end being disposed at the inner surface of the metal member, the second end being disposed at the outer surface of the metal member, and in which the smallest physical dimension of at least one of the metal fibers at the second end is greater than the smallest physical dimension of at least one of the metal fibers at the first end.

7. The metal catalytic tube as set forth in claim 5, in which the metal fibers of the sheet are bonded with one another throughout the metal catalytic tube.

8. The metal catalytic tube as set forth in claim 5, in which the spiral-wound sheet is of a substantially circular cross-section.

9. The metal catalytic tube as set forth in claim 1, in which the metal member includes a hollow metal pipe, the metal fibers being disposed on the metal pipe.

10. The metal catalytic tube as set forth in claim 9, in which the metal fibers are bonded to the metal pipe.

11. The metal catalytic tube as set forth in claim 1, in which the metal fibers at the inner surface are compressed to a greater degree than the metal fibers at the outer surface.

12. The metal catalytic tube as set forth in claim 1, in which the metal fiber of the metal member are bonded together, the metal fibers at the inner surface being on average physically smaller than the metal fibers at the outer surface.

13. The metal catalytic tube as set forth in claim 1, in which the metal member includes a plurality of layers of metal fibers, the inner surface being defined by a first layer of the plurality of layers, the outer surface being defined by a distal layer from the inner surface, the porosity of the distal layer being greater than the porosity of the first layer.

14. A metal catalytic tube comprising;

a tube wall comprising and an outer surface and an inner surface defining a cavity, the tube wall further comprising:

a plurality of particles sinter bonded together and comprising porosity between adjacent particles;

a portion of the plurality of particles comprising catalytic material;

an inner portion of the tube wall comprising particles sufficiently densified during sinter bonding so that a first fluid passes through the cavity substantially without leakage of the first fluid through the inner surface into an inner region of the tube wall between the inner surface and the outer surface; and an outer portion of the tube wall comprising particles sinter bonded to exhibit a degree of porosity greater than a degree of porosity of the inner portion to allow a second fluid flowing over the outer surface to flow into the inner region for contacting particles comprising the catalytic material within the inner region.

15. The metal catalytic tube of claim 14, further comprising a size of the plurality of particles being greater proximate the outer surface than proximate the inner surface.

16. The metal catalytic tube of claim 14, wherein the portion of the plurality of particles comprising catalytic material further comprises particles coated with the catalytic material.

17. The metal catalytic tube of claim 14 having a hollow substantially cylindrical configuration.

18. The metal catalytic tube of claim 14, wherein the particles comprising catalytic material comprise least one catalytic material selected from the group consisting of platinum, palladium, rhodium and iridium.

19. The metal catalytic tube of claim 14 wherein the particles comprise a powder.

20. The metal catalytic tube of claim 14, wherein the particles comprise a plurality of fibers.

21. The metal catalytic tube of claim 14, wherein the particles comprise a plurality of fibers formed into a sheet, with the sheet being spiral wound and sinter bonded to form the tube wall.

22. The metal catalytic tube of claim 14, wherein the particles comprise a mesh.

23. The metal catalytic tube of claim 14, further comprising a plurality of layers, each layer exhibiting a degree of porosity different from an adjacent layer.

24. The metal catalytic tube of claim 14, wherein the plurality of particles are sinter bonded to form a graded porosity across the tube wall.

25. The metal catalytic tube of claim 14, further comprising a metal pipe comprising an exterior surface disposed adjacent the inner surface.

26. The metal catalytic tube of claim 14, wherein the tube wall further comprises:

a layer of ceramic material disposed below an outermost layer of particles; and the outermost layer of particles comprising the catalytic material.

27. The metal catalytic tube of claim 14, further comprising the portion of the plurality of particles comprising a catalytic material being disposed at the outer surface.

28. The metal catalytic tube of claim 14, further comprising the particles comprising at least one particle selected from the group consisting of metal fiber, metal powder, metal wire and metal mesh.

29. The metal catalytic tube of claim 14, wherein the tube wall comprises a spiral wound sheet formed of the particles.

30. The metal catalytic tube of claim 29, further comprising the sheet comprising particles having a size larger at one end than at a second end.

31. A combustion turbine engine comprising the metal catalytic tube of claim 14.

* * * * *